United States Patent [19]

L'Hermite

[11] Patent Number: 4,980,604

[45] Date of Patent: Dec. 25, 1990

[54] SHEET-TYPE DYNODE ELECTRON MULTIPLIER AND PHOTOMULTIPLIER TUBE COMPRISING SUCH DYNODES

[75] Inventor: Pierre L'Hermite, Brive, France

[73] Assignee: U.S. Philips Corp., New York, N.Y.

[21] Appl. No.: 370,215

[22] Filed: Jun. 22, 1989

[30] Foreign Application Priority Data

Jul. 5, 1988 [FR] France ..... 88 09083

[51] Int. Cl.[5] ..... H01J 43/20; H01J 43/26

[52] U.S. Cl. ..... 313/533; 313/536; 313/105 R

[58] Field of Search ..... 313/532, 533, 534, 536, 313/542, 103 CM, 105 R, 105 CM

[56] References Cited

U.S. PATENT DOCUMENTS 3,265,916 8/1966 Vestal ..... 313/105
4,117,366 9/1978 Davis ..... 313/536 X
4,182,969 1/1980 Catanese et al. ..... 313/536 X
4,311,939 1/1982 Faulkner et al. ..... 313/533

FOREIGN PATENT DOCUMENTS 165119 12/1985 European Pat. Off. ..... 313/533
2549288 1/1985 France .

*Primary Examiner*—Sandra L. O'Shea
*Attorney, Agent, or Firm*—William L. Botjer

[57] ABSTRACT

An electron mulitplexer dynode (D) comprising two parallel disposed half-dynodes (d, d') to which an equal potential (V) is applied, and which are in the form of metal sheets (10, 20) in which apertures (11, 21) are formed. According to the invention, the second half-dynode (d'), called emitting half-dynode, has an electron surface (23), and the said emitting half-dynode (d') and the first half-dynode (d), called extracting half-dynode, are arranged so as to be staggered relative to each other.

3 Claims, 3 Drawing Sheets

SHEET-TYPE DYNODE ELECTRON MULTIPLIER AND PHOTOMULTIPLIER TUBE COMPRISING SUCH DYNODES

BACKGROUND OF THE INVENTION

The invention relates to a "sheet"-type electron multiplier dynode, i.e., the dynode comprises two half-dynodes which are in the form of sheets in which apertures are formed which are arranged according to a pattern having a specific configuration. The invention also relates to an electron multiplier and a photomultiplier tube comprising such multiplier dynodes.

The invention can be very advantageously used in the field of photomultiplier tubes.

The use of dynodes and "sheet"-type multipliers in photomultipliers tubes is known from, for example, French Patent Specification No. 2 549 288. This specification describes an electron multiplier dynode which comprises two parallel arranged half-dynodes to which an equal potential is applied and which are manufactured by using metal sheets in which apertures are formed which are regularly arranged according to a recurring pattern having one and the same basic configuration. In a multiplier comprising a number of such dynodes, the first half-dynode serves as the electron-extracting electrode, which extracts the electrons emitted by the preceding dynode, and the second half-dynode is the electron-emitting electrode. For this reason, the apertures in the emitting half-dynode are substantially funnel-shaped so that the walls of the apertures, which are covered by secondary-emission material, form the useful electron multiplication zones. The secondary electrons thus formed, which are attracted by the next extracting electrode, pass through the emitting half-dynode via the aperture from which they originate. Photomultiplier tubes in which "sheet"-type multipliers are used have many advantages. While occupying little space, the photomultiplier tubes have a large collection surface, which renders them very advantageous when the electrons are incident in the form of a wide beam, as in the case of proximity focussing or in the case of application in combination with a large focussing first dynode. In addition, the possibility of partitioning the multiplier enables the formation of a certain number of secondary photomultiplier tubes in one and the same tube, which has been advantageously used in nuclear physics, for example, for exactly localizing detected particles.

However, the electron multiplier dynodes known from the present state of the art have the disadvantage that the funnel-shaped apertures which are necessary for the multiplying the electrons require a relatively costly manufacturing process comprising chemical attack and the use of masks. Moreover, it is to be noted, that with a view to increasing the multiplier surface, the output opening of the apertures is relatively small, which complicates the correct positioning of the metal sheets relative to one another inside one and the same electron multiplier.

SUMMARY OF THE INVENTION

It is an object of the invention to provide an electron multiplier dynode comprising a first half-dynode, called extracting half-dynode, and a second half-dynode, called emitting half-dynode, the half-dynodes being parallel disposed, the half-dynodes being are in the form of sheets in which apertures are formed which are arranged according to a pattern having the same basic configuration, the second half-dynode having an electron multiplication surface for electron multiplication, which multiplier dynode can be manufactured at a low cost and whose mounting is facilitated by less strict tolerances, however, without adversely affecting the collection efficacy.

According to the present invention, this object is achieved in that the said apertures have straight edges and in that the two half-dynodes are arranged so as to be staggered relative to one another, so that each aperture of one the half-dynodes is located opposite the centre of a basic configuration of the other half-dynode.

The apertures have straight edge, because they serve only to pass electrons, consequently, their manufacture is much easier and cheaper and can be carried out by using conventional mechanical means. In addition, the diameter of the apertures can be increased without substantially affecting the collection power of the emitting half-dynodes because the electron multiplication surface is substantially much larger than in the case of the state-of-the-art dynodes, so that the mounting of the dynodes in an electron multiplier is less critical. According to the invention, an electron multiplier comprising, in succession, a first emitting half-dynode and a plurality of electron multiplier dynodes, is characterized in that each extracting half-dynode is arranged such that it coincides with the preceding emitting half-dynode, and in that increasing potentials are applied to the first emitting half-dynode and the successive multiplier dynodes. Consequently, the extracting half-dynodes can extract secondary electrons formed by the preceding emitting half-dynodes without obstructing the passage of these electrons towards the following emitting half-dynodes, in so far as the apertures of the extracting half-dynodes coincide with the apertures of the preceding emitting half-dynodes.

Finally, a photomultiplier tube comprising a photocathode, a first dynode, an electron multiplier according to the invention, which is coupled to the first dynode, and an anode, is characterized in that an input grid is provided between the said first dynode and the multiplier, which grid is arranged parallel to the first emitting half-dynode, the potential applied to the grid being substantially equal to that applied to the said first emitting half-dynode.

As will be described in more detail hereinafter, the input grid serves as a screen electrode for the first emitting half-dynode in order to ensure that the electrons emitted by the said emitting half-dynode can be extracted by the extracting half-dynode of the next dynode.

BRIEF DESCRIPTION OF THE DRAWINGS

The invention will be explained in greater detail by means of the following description and with reference to the accompanying drawings which are to be regarded as non-limitative examples.

DETAILED DESCRIPTION OF THE EMBODIMENT

Figure 1:
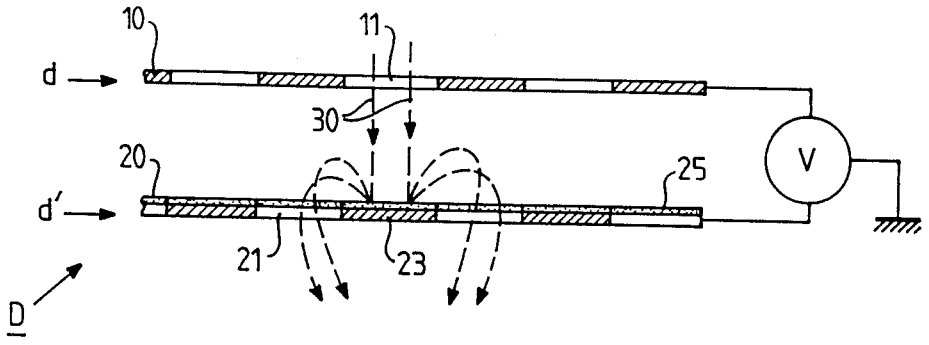
FIG. 1 is a sectional view of an electron multiplier dynode according to the invention.
Figure 2:
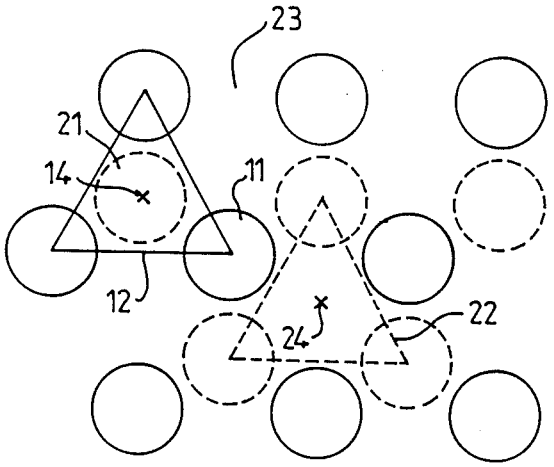
FIG. 2 is a top view of the dynode of FIG. 1.

FIG. 1 is a sectional view of an electron multiplier dynode D which comprises two half-dynodes d, d' which are parallel disposed and to which an equal potential V is applied. Said half-dynodes are in the form of metal sheets 10, 20, which are made from, for example, mild steel, and in which apertures 11, 21 are formed which are arranged according to a regular recurring pattern having one and the same basic configuration 12, 22. In the embodiment shown in FIG. 2, the basic configurations 12, 22 are both in the form of an equilateral triangle, but they may alternatively be in the form of a square, a rectangle, etc. As is shown in FIGS. 1 and 2, the apertures 11, 21 are straight-edged, and can therefore be formed very easily. Typically, the said apertures 11, 21 may have a diameter of 0.5 mm, whereas the distance between two consecutive apertures is of the order of 1 mm. The second half-dynode d', called emitting half-dynode, is covered by a secondary emission material 25, such as antimony or beryllium oxide, the multiplication of the incident electrons 30 taking place on the surface 23 of the corresponding metal sheet 20, and this second dynode d' may be made of a secondary emission material such as a copper-beryllium alloy which is subjected to the classical treatment: migration due to heating of the beryllium and oxidation. FIGS. 1 and 2 show that the emitting half-dynode d' and the first half-dynode d, called extracting half-dynode, are arranged so as to be staggered relative to one another, so that each aperture 11, 21 in one of the half-dynodes d, d' is located opposite the centre 24, 14 of a basic configuration 22, 12 of the other half-dynode d', d. In this manner, electrons 30 which pass through the extracting half-dynode d via an aperture 11 are inevitably incident on the emitting half-dynode 20 in an area exhibiting secondary emission.

Figure 3:
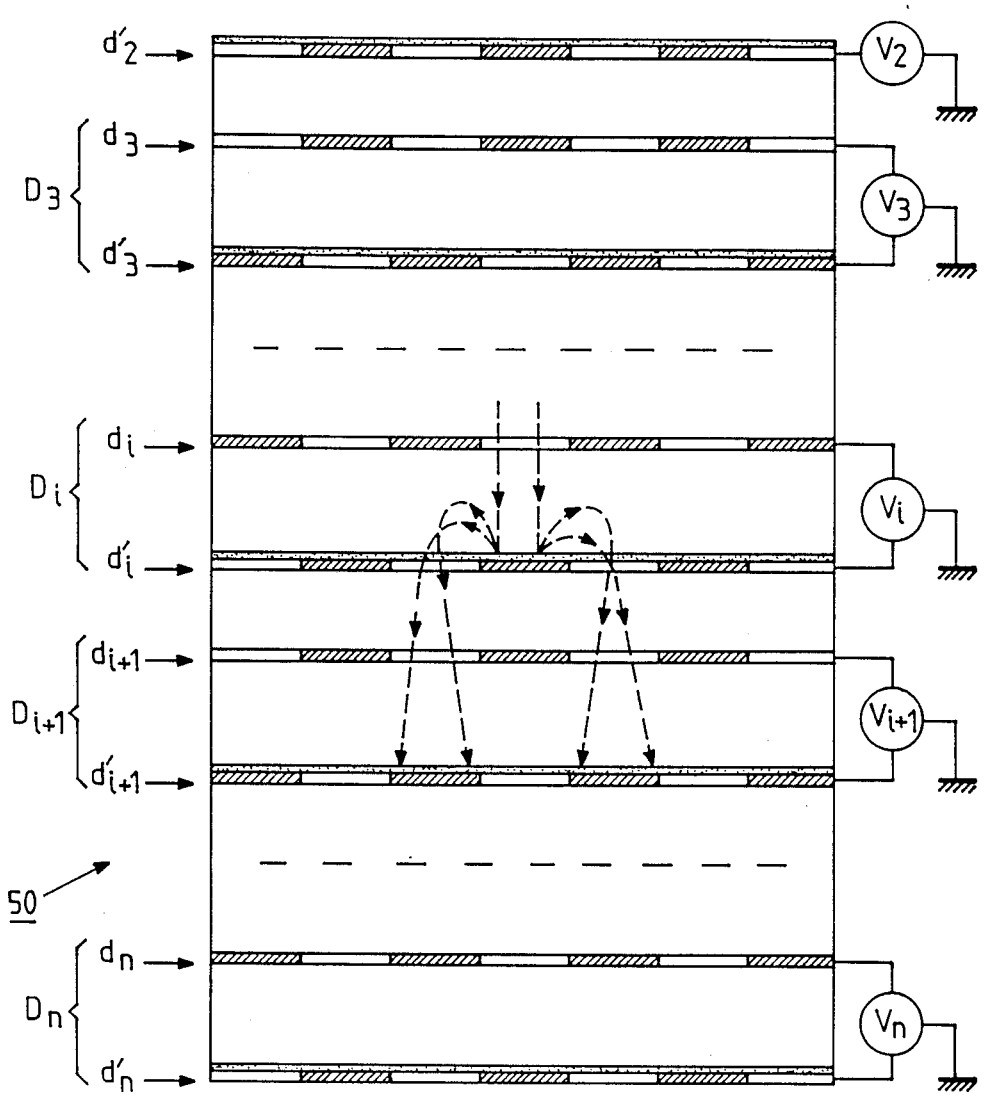
FIG. 3 is a sectional view of an electron multiplier according to the invention.

An electron multiplier 50 shown in FIG. 3 comprises, in succession, a first emitting half-dynode $d'_2$ and a plurality of electron multiplier dynodes $D_3 \ldots, D_i, D_{i+1}, \ldots, D_n$, of the type described above with reference to FIGS. 1 and 2. As is shown in FIG. 3, each extracting half-dynode $d_{i+1}$ is positioned so as to coincide with the preceding emitting half-dynode $d'_i$. Moreover, in order to enable the electrons to advance from the first emitting half-dynode $d'_2$ to the last emitting half-dynode $d'_n$, increasing potentials $V_2, V_3, \ldots, V_i, V_{i+1}, \ldots, V_n$ are applied to the first emitting half-dynode $d'_2$ and the successive multiplier dynodes $D_3, \ldots, D_i, D_{i+1} \ldots, D_n$. For example, the extracting half-dynode $d_{i+1}$ serves to draw the electrons emitted by the emitting half-dynode $d'_i$ towards the emitting half-dynode $d'_{i+1}$, but it also serves to electrically screen the emitting half-dynode $d'_{i+1}$ from the preceding dynodes. In the absence of this screening, which creates a region having a weak field between the half-dynodes $d_{i+1}$ and $d'_{i+1}$, were to be absent, it would be impossible for the electrons emitted by the emitting half-dynode $d'_{i+1}$ to be extracted by the next extracting half-dynode $d_{i+2}$. In order to ensure that the screening effect suffices, it is desirable for the distance between an extracting half-dynode and the emitting half-dynode of one and the same dynode to be relatively large, for example from 0.5 to 0.8 mm. The distance between an emitting half-dynode and the next extracting half-dynode may be much smaller, of the order of a few tenths of 1 mm, typically 0.3 mm.

Figure 4:
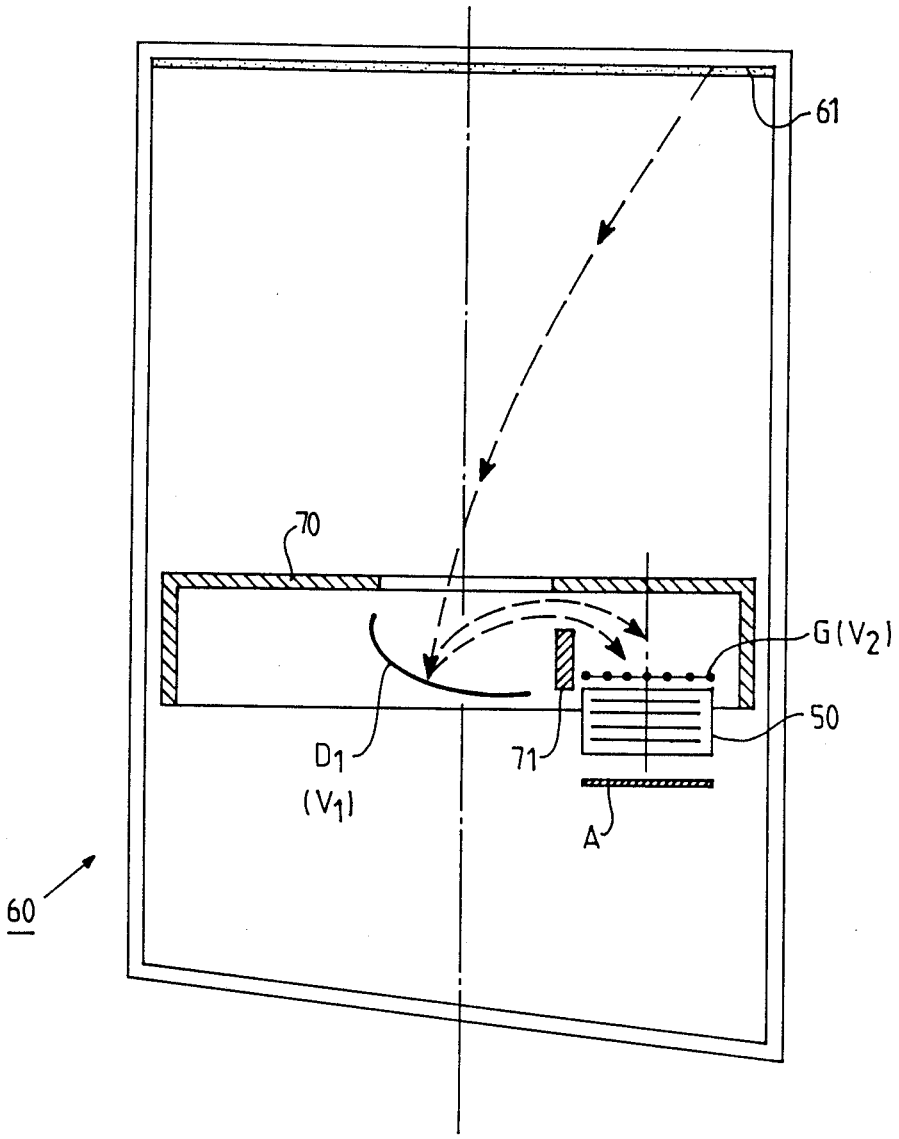
FIG. 4 is a sectional view of a photomultiplier tube according to the invention.

FIG. 4 is a sectional view of a photomultiplier tube 60 comprising a photocathode 61, a first cylindrical dynode $D_1$ of large dimensions, a multiplier 50 which corresponds to the one shown in FIG. 3, and an anode A. By way of example, the electron multiplier 50 is coupled to the first dynode $D_1$ using coupling means 70, 71 as described in the unpublished French Patent Application No. 88 07 778, but other coupling means known to those skilled in the art may alternatively be used. As FIG. 4 shows, an input grid G is provided between the first dynode $D_1$ and the multiplier 50, which grid is disposed parallel to the first emitting half-dynode $d'_2$ and the potential applied to the grid is substantially equal to the potential $V_2$ applied to the said first emitting half-dynode $d'_2$. Consequently, the said input grid G and the emitting first half-dynode together form a second dynode $D_2$ which is equivalent to the dynodes of higher order $D_3, \ldots, D_n$. The principal function of the input grid G is to screen the first emitting half-dynode $d'_2$ with a suitable transparancy. As is customary, the potential $V_1$ of the first dynode $D_1$ is lower than the potential $V_2$ of the equivalent dynode $D_2$.

I claim:

1. An electron multiplier dynode (D) arrangement comprising a first half-dynode (d), called an extracting half-dynode, and a second half-dynode (d'), called an emitting half-dynode, the half-dynodes (d, d') are disposed in parallel, the half-dynodes being in the form of planar sheets in which apertures are formed according to a pattern having a single basic configuration, the second half-dynode (d') having an electron multiplication surface for electron multiplication, wherein the improvement comprises that the said apertures have straight edges and in that the two half-dynodes are arranged so as to be staggered relative to one another, so that each aperture of the (d, d') of the half-dynodes is located opposite the center of a basic configuration of the other (d, d') half-dynode said electrons passing through said apertures.

2. An electron multiplier dynode arrangement as claimed in claim 1 comprising, in succession, a first emitting half-dynode ($d'_2$) and a plurality of electron multiplier dynodes (D3, $\ldots, D_i, D_{i+1}, \ldots, D_n$), characterized in that each extracting half-dynode ($d_{i+1}$) is arranged so as to coincide with the preceding emitting half-dynode ($d'_i$), and in that increasing potentials ($V_2, V_3, \ldots, V_i, V_{i+1}, V_n$) are applied to the first emitting half-dynode ($d'_2$) and the successive multiplier dynodes ($_3, \ldots, D_i, D_{i+1}, \ldots, D_n$).

3. A photomultiplier tube comprising a photocathode, a first dynode, an electron multiplier, an anode and an input grid provided between the first dynode and the electron multiplier, said electron multiplier comprising a series of first and second half-dynodes, said first half-dynodes being called an extracting half-dynode and said second half-dynodes being called an emitting half-dynode, the half-dynodes being in the form of planar sheets disposed in parallel, said planar sheets including a series of straight edged apertures which are formed in accordance with a pattern having a single basic configuration, said apertures permitting electrons to pass therethrough, the second half-dynode having an electron multiplication surface for electron multiplication, said apertures of said two half-dynodes being arranged so as to be off-set relative to one another so that each aperture of one of the half-dynodes is located opposite the center of the basic configuration of the other half-dynode.

* * * * *